US006337970B1

(12) United States Patent
Okamoto et al.

(10) Patent No.: US 6,337,970 B1
(45) Date of Patent: Jan. 8, 2002

(54) IMAGE FORMING APPARATUS HAVING SHEET PROCESSOR

(75) Inventors: Kiyoshi Okamoto, Toride; Shigeru Sugita, Sayama; Tsuyoshi Moriyama, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/261,955

(22) Filed: Mar. 3, 1999

(30) Foreign Application Priority Data

Mar. 9, 1998 (JP) ..... 10-057086

(51) Int. Cl.[7] ..... G03G 15/00; B65H 33/04

(52) U.S. Cl. ..... 399/407; 399/381; 399/408; 399/410; 270/58.08; 270/58.09

(58) Field of Search ..... 355/407, 408; 399/16, 43, 46, 75, 76, 77, 361, 381, 390, 407, 408, 410; 270/58.08, 58.09

(56) References Cited

U.S. PATENT DOCUMENTS 5,625,860 A * 4/1997 Maeda et al. ..... 399/403
5,746,162 A * 5/1998 Hosoi et al. ..... 270/58.09
5,793,298 A * 8/1998 Matsuura ..... 340/679
6,006,065 A * 12/1999 Seki ..... 399/407
6,027,107 A * 2/2000 Natsume et al. ..... 270/37
6,029,026 A * 2/2000 Natsume et al. ..... 399/82
6,076,817 A * 6/2000 Kobayashi et al. ..... 270/58.09
6,088,568 A * 7/2000 Ohtani ..... 399/408

* cited by examiner

*Primary Examiner*—Russell Adams
*Assistant Examiner*—Rodney Fuller
(74) *Attorney, Agent, or Firm*—Fitzpatrick, Cella, Harper & Scinto

(57) ABSTRACT

An image formation apparatus has a sheet processor in which the setting of punch action is permitted during a specified period of time, even after image formation is started when the setting of a punch action has been forgotten. When the start key of the image formation apparatus is operated for starting image formation in a situation in which a setting of an action for punching at least one hole in a sheet by a punch setting button is forgotten, an action setting by the punch setting button is permitted during a specified period of time taken after inputting of the start for image formation, so that sheet processing and image formation can be continued without pausing the apparatus.

11 Claims, 7 Drawing Sheets

IMAGE FORMING APPARATUS HAVING SHEET PROCESSOR

BACKGROUND OF THE INVENTION

1. Field of the Invention

The present invention relates to an image formation apparatus having a sheet processor, and more particularly, to an image formation apparatus having a sheet processor for stacking and sorting sheets ejected from the apparatus, the processor having a punching means for punching holes in sheets.

2. Description of the Related Art

In a conventional sheet sorter for processing sheets, approximately 20 trays for stacking sheets (hereinafter referred to as "bins") are arranged in such a manner as to be mutually separated by a specified distance; sheets ejected from the image formation apparatus sequentially in a specific period of time are carried in order into specified bins by a carrying means.

Regarding a method for punching holes in sheets, which is employed in such a sheet sorter, a method for punching holes into a pile of sheets placed in the bins is known. This method, however, has some problems: while punching of holes is being performed, the subsequent sheet cannot be carried to the sheet processor, since punching of holes is performed on a pile of sheets. In addition, depending on punching capability, it is necessary to suspend the carrying of sheets from the image formation apparatus to the sheet processor every time holes are punched into a pile of sheets. As a result, these problems hinder the improvement of processing speed.

Accordingly, for example, a method for respectively punching holes in each of the sheets ejected from the apparatus sequentially in a specified period of time is known; furthermore, there is known a method in which punching is performed without an increase in sheet processing time, regardless of whether punching processing is performed, by disposing a punching means composed of a punch and a die on a sheet carrying path, and bringing a sheet carrying speed into synchrony with a punching speed so as to perform punching without stopping the sheet which is being carried.

In the conventional examples, when an action of punching is selected through the image formation apparatus, the action of punching is required to be input before the starting action for forming an image in the apparatus is input. Thus, when image formation is started without setting of punching, image formation by the apparatus must be suspended.

SUMMARY OF THE INVENTION

The present invention has been made to overcome these problems. It is an object of the present invention to provide an image formation apparatus having a sheet processor in which an action setting of a punching unit can be performed during a specified period of time, even after image formation starts.

According to an aspect of the present invention, there is provided an image formation apparatus having a main section and a sheet processor section, which includes; an image forming unit for forming an image on a sheet; an ejecting unit for ejecting the sheet on which the image is formed by the image forming unit, wherein the image forming unit and the ejecting unit are contained in the main section of the image formation apparatus; a punching unit for punching at least one hole in a sheet ejected from the main section of the image formation apparatus, the punching unit being disposed in the processor; and a punch action selection unit for selecting punch action. The image formation apparatus has a controlling unit for controlling the punch action selecting unit in such a manner that a punch action selection by the punching unit is permitted during a specified period of time after start of image formation signal is input.

The image formation apparatus having a sheet processor described above may also include a sheet detecting unit for detecting the arrival of a sheet at the sheet processor; a specified period of time taken after the starting of the image formation is input may coincide with the period of time taken for the first sheet upon which an image has been formed from the main section of the image formation apparatus to arrive at the sheet detecting unit.

Preferably, the sheet detecting unit described above is an entry sensor which is arranged upstream of the punching unit.

According to an another aspect of the present invention, there is provided an image formation apparatus which includes: an image forming unit for forming an image on a sheet; a carrying path for guiding the sheet on which the image is formed by the image forming unit; an ejecting unit for ejecting the sheet guided by the carrying path; a stacking unit for stacking the sheet ejected by the ejecting unit; a processing unit disposed in the carrying path for performing processing on the sheet guided by the carrying path; a selection signal input unit for inputting a selection signal for selecting a mode either for operating the processing unit or for not operating the same; a start signal input unit for inputting a start signal for starting an image formation; and a controlling unit for controlling the processing unit according to the mode selected by the input selection signal when the selection signal is input after the start signal is input.

Based on the arrangement above, when a punch action is selected by the punch action selection unit, the sheet upon which an image has been formed is ejected and carried from the main section of the image formation apparatus is punched by the punching unit. Even after input of the starting of the image forming action performed by the main section of the image formation apparatus, as long as it occurs during a specified period of time, a selection of a punch action by the punch action selection unit can be accepted. Thus, the setting of the punch action selection unit within the specified period of time permits a punch action by the punching unit to be performed, even if the action setting of the punch action selection unit is forgotten; and there is no need to pause the image formation apparatus halfway through a job, so that a satisfactory use environment of the apparatus can be obtained.

DESCRIPTION OF THE PREFERRED EMBODIMENTS

Figure 1:
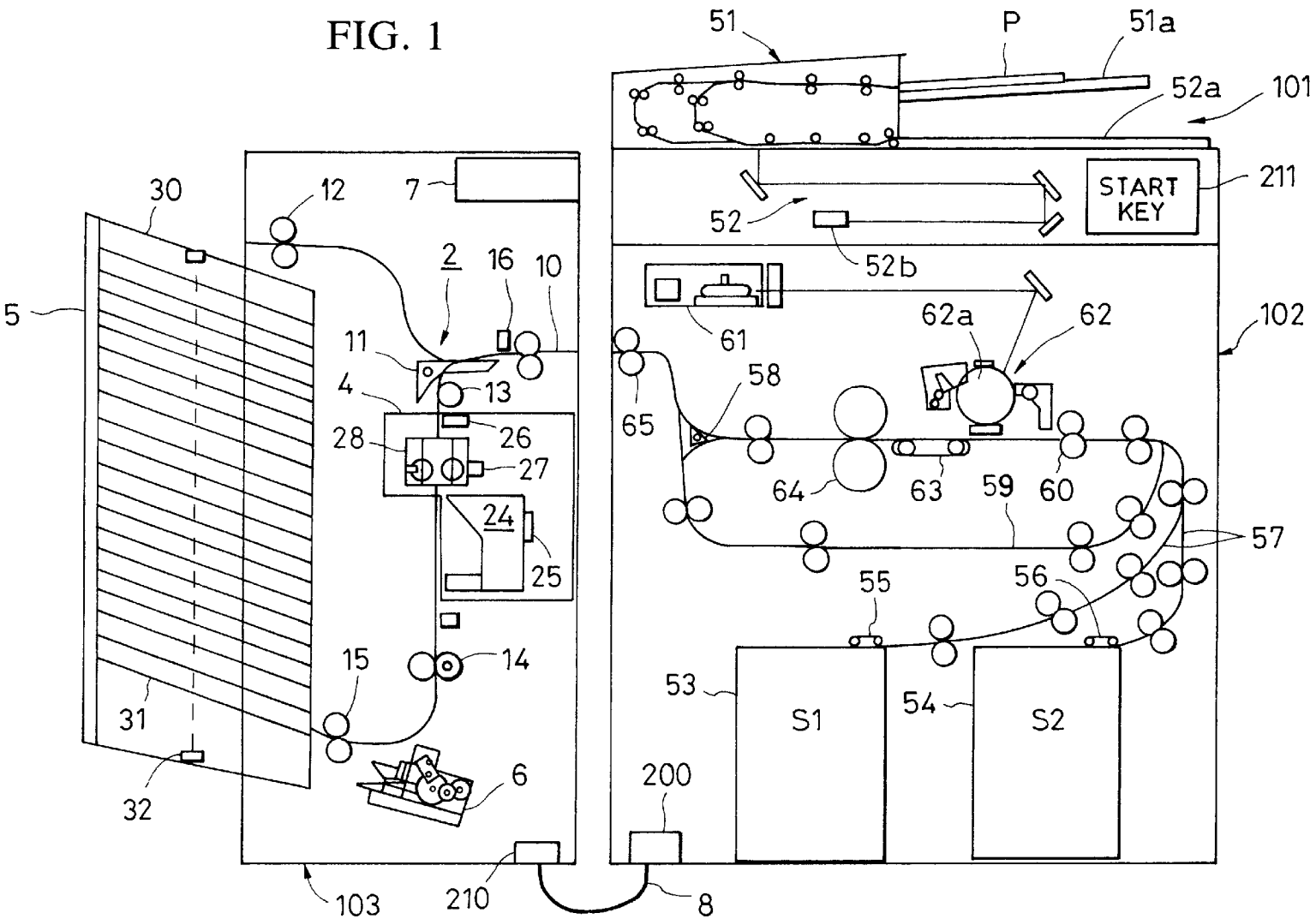
FIG. 1 is a cross-sectional front view of an image formation apparatus in which a sheet processor of the present invention is applied.

Referring now to the drawings, a description will be given of an embodiment of the present invention. FIG. 1 is a sectional view which shows an overall structure of an image formation apparatus including a read/feed device 101 for feeding and reading a document sheet, a main section of the image formation apparatus 102, and a sheet sorter 103.

In the system, the read/feed device 101 has an automatic document feeder 51 and an optical unit 52: the feeder 51 feeds an original document paper P which is set on a document feeding tray 51*a* to a document read position formed of a platen glass 52*a*, and carries it to an ejecting position after the image of the original document is read, while the optical unit 52 scans the document paper P to be read. The read image of the document is converted into electric signals by an image processor 52*b*.

In addition, the image formation apparatus 102 has a plurality of record paper containers 53 and 54 for stacking record sheets S1, S2 of different sizes and a plurality of record sheet feeders 55 and 56 for feeding the record sheets. The sheet fed from one of the record sheet containers 53 and 54 is carried to a pair of resist rollers 60 of the image formation apparatus 102 via a sheet carrying path 57.

Numeral 61 denotes a laser scanner for scanning by a laser beam based on the image information read by the optical unit 52, and numeral 62 denotes an image forming means (or unit) in which scanning performed on a photosensitive drum 62*a* by the laser scanner 61 permits formation of a toner image. The sheet on which an image is formed by the image forming means 62 after being carried by the resist rollers 60 in a specified timing is carried onto a carrying path 10 of the sheet sorter 103 by a carrying belt 63, fix rollers 64, and ejection rollers 65 as an ejecting means.

The sheet sorter 103 is composed of a bin unit 5 for sorting out sheets for stacking and holding; a sheet carrying unit 2 for carrying a sheet ejected from the image formation apparatus 102 to the sheet sorter 103; a punching unit 4 as a processing means for punching holes in the sheet which is being carried within the sheet carrying unit 2; a staple unit 6 for stapling a pile of sheets stacked in the bin unit 5; an operation unit 7 for inputting an action of the sheet sorter 103, etc.

Figure 2:
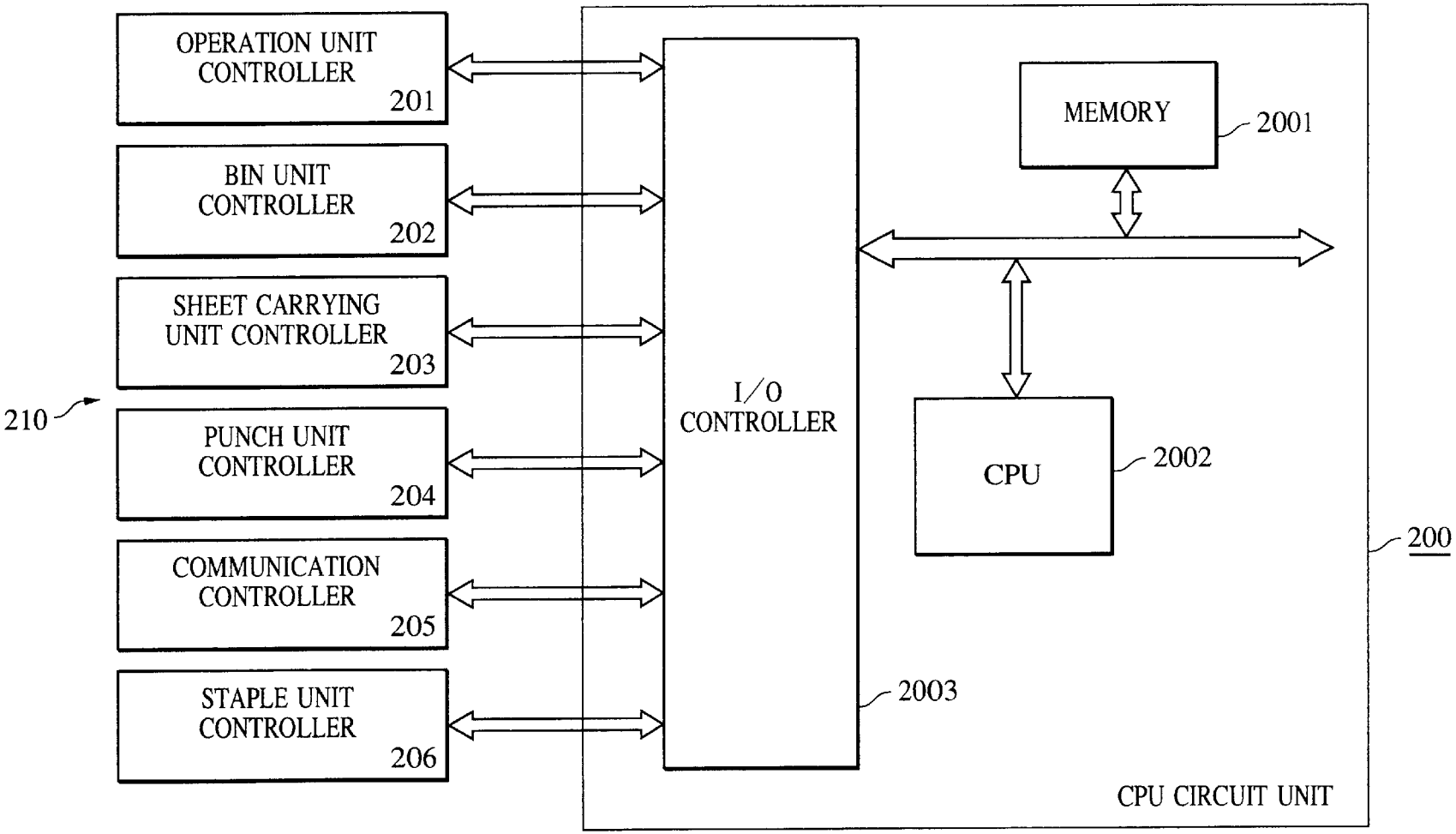
FIG. 2 is a block diagram according to an embodiment of control of the sheet processor of the present invention.
Figure 3:
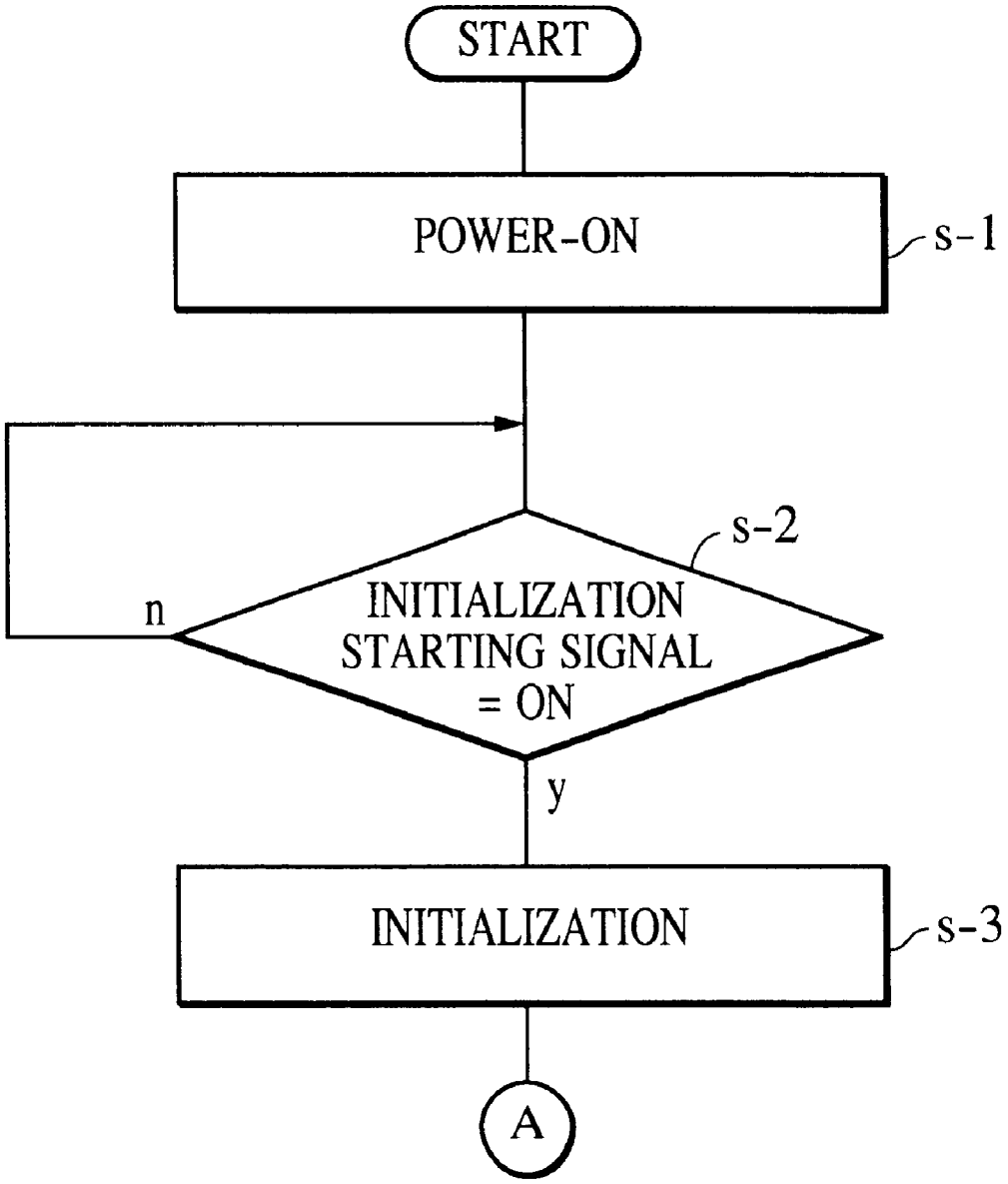
FIGS. 3 through 7 are flowcharts according to actions of the sheet processor of the present invention.
Figure 4:
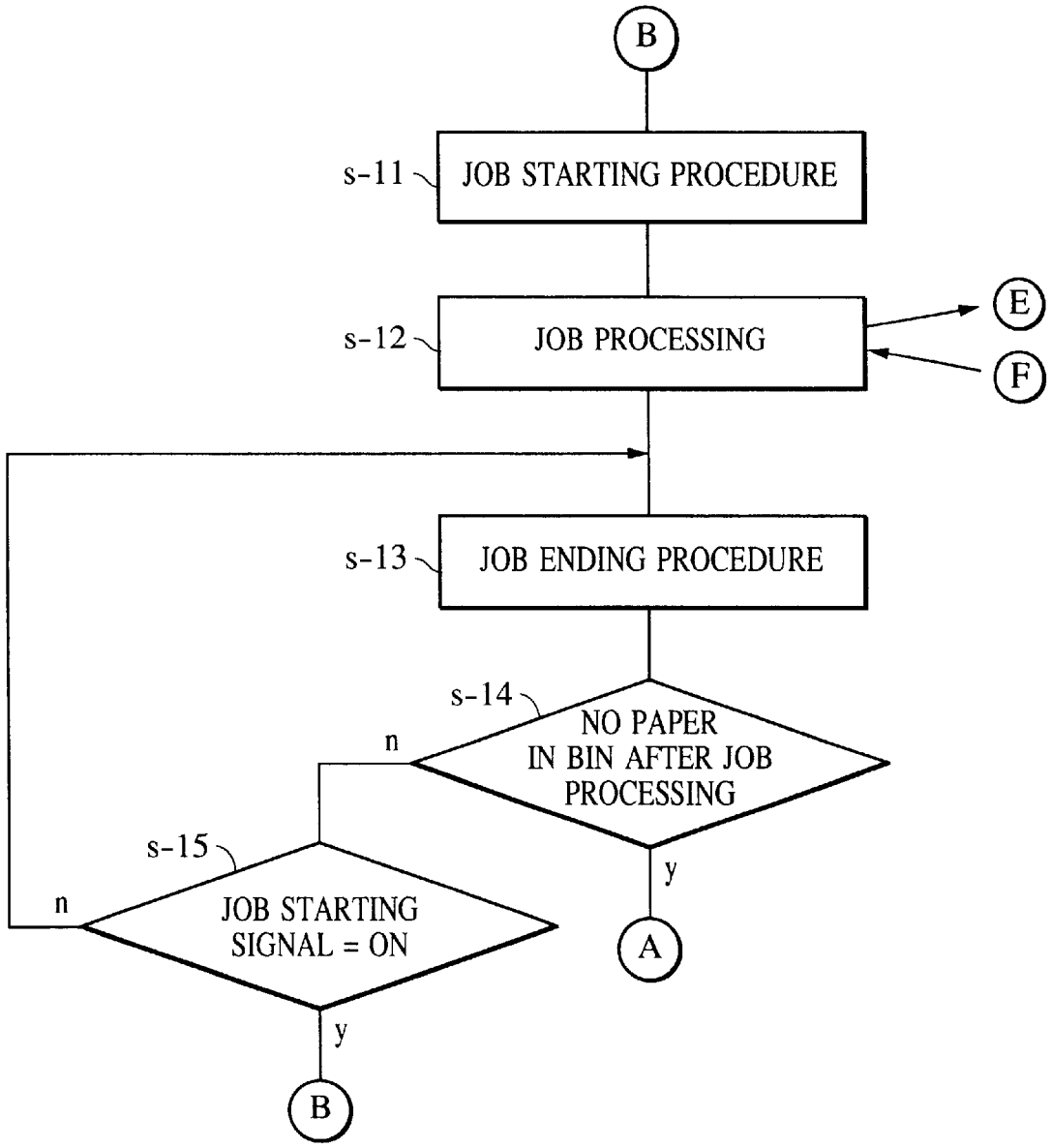
Figure 5:
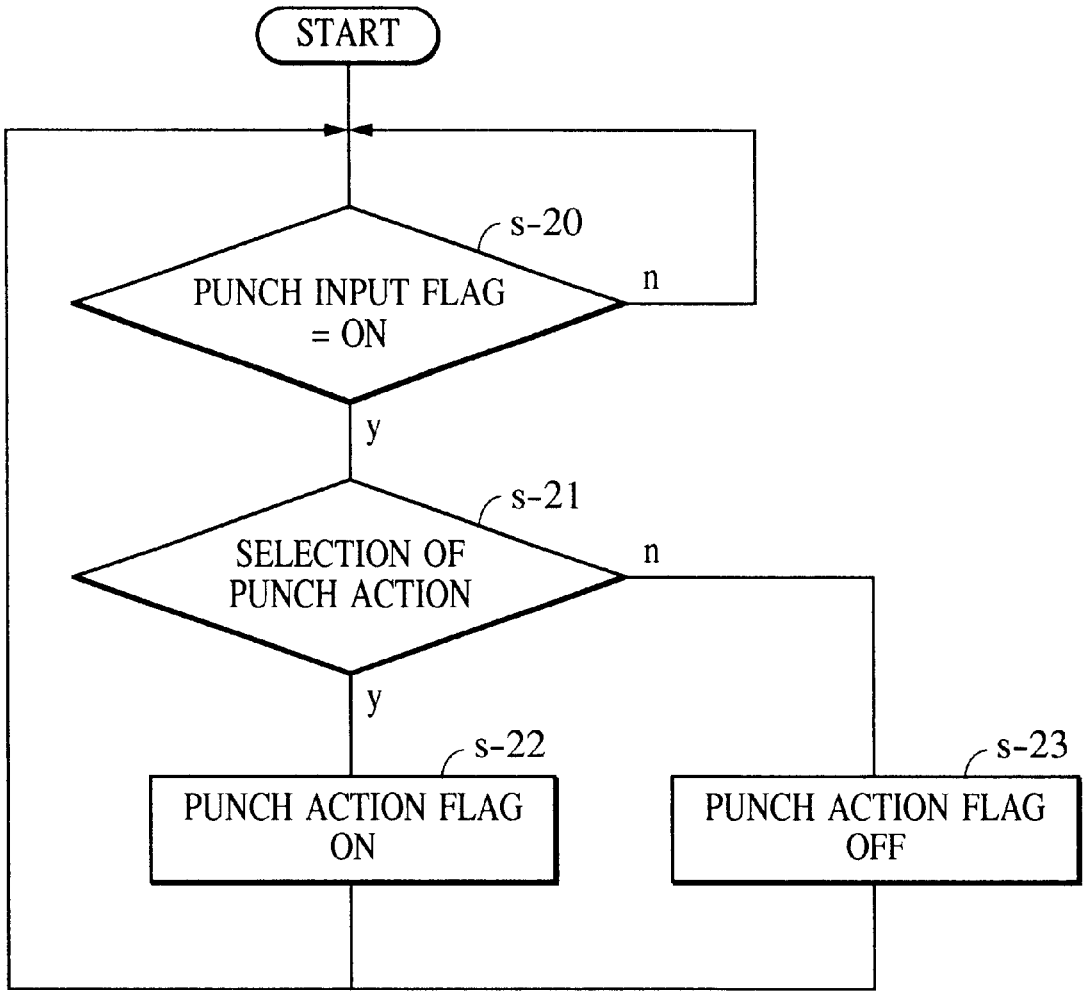
Figure 6:
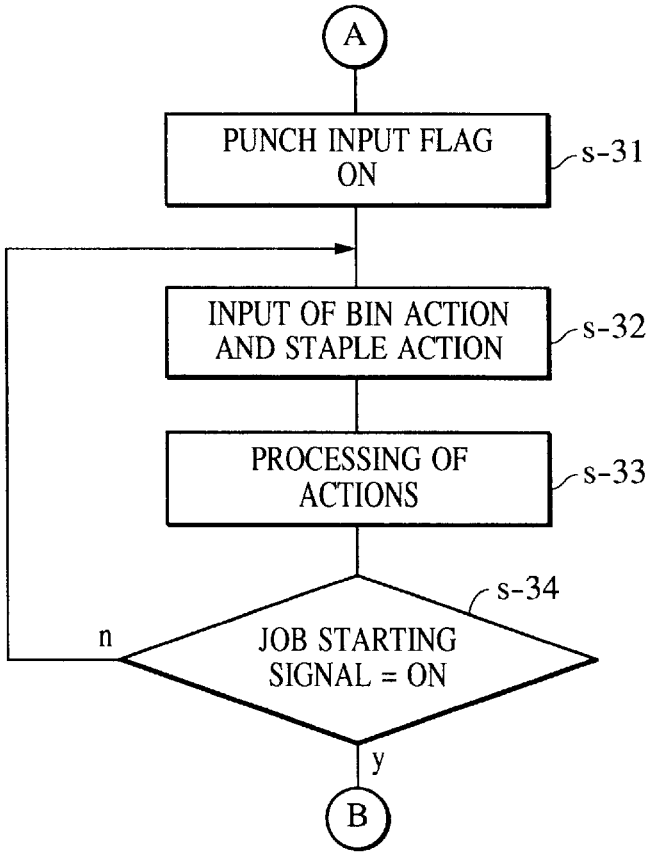

Next, a description will be given of a basic operation of the apparatus, referring to FIG. 2 which is a block diagram showing a structure of a controller shown in FIG. 1 employed in the embodiment.

A controller circuit unit 200, which is a CPU circuit unit, includes a central processing unit 2002 (hereinafter referred to as "CPU") for calculating by using a specified program, or controlling the processing unit as a whole; ROM for containing a program and specified data; RAM for containing data temporarily corresponding to signal processing; or an IC card, a floppy disk, etc.; and further includes, memory 2001 for writing/reading a program and data, and an I/O controller 2003 for transmitting and controlling an input/output signal.

Furthermore, a timer for counting time is included in the CPU 2002, while a plurality of registers is included in the CPU 2002 and the I/O controller 2003 so as to use data signals for a temporary memory/read processing. These devices are respectively controlled by a control signal from the CPU circuit unit, which is a controller circuit unit 200.

The controller circuit unit 200 operates a unit controller 201, a bin unit controller 202, a sheet carrying unit controller 203, a punch unit controller 204, a communication controller 205, and a staple unit controller 206, which are included in the controller 210 of the sheet processor, by setting of an action input from the main section of the image formation apparatus 102 or setting of an action input from the operation unit 7 by the communication controller 205. Numeral 8 denotes a communication line, which connects the controller circuit unit 200 to the controller 210 of the sheet processor. Numeral 211 denotes a start key, which is a start signal input means for inputting a start signal for starting image formation performed by the image formation apparatus 102.

In this arrangement, when a user places original documents in the document feeding tray 51*a* of the automatic document feeder 51 disposed in the read/feed device 101 and sets an action mode to designate start of copying by using an operation unit (not shown) of the image formation apparatus 102, each of the documents P is fed one by one through the automatic document feeder 51 to be read by the optical unit 52 as a reader.

In the optical unit 52, a CCD line sensor performs photoelectric conversion of the exposed document image so as to read it as electric signals. Then, different kinds of image processing are performed on the read image signal corresponding to a setting by a user through the operation unit of the image formation apparatus 102 so as to be converted into an optical signal used for photoreceptor exposure through the image processor 52*b*. After this, through the process including electric charging, exposure, latent-image formation, printing, separation, and fixing, which is conventional in electrophotography, the image is recorded on the sheet. The sheet on which the image is formed is carried to the carrying path 10 of the sheet sorter 103 through the carrying belt 63 and the ejecting rollers 65 as an ejecting means. In the sheet sorter 103, the controller circuit unit 200 allows the sheet carrying unit controller 203 to operate corresponding to an action set by the communication controller 205.

The communication controller 205 receives data such as size data of the sheet ejected from the image formation apparatus 102, processing speed data of the image formation apparatus 102, data for designating an action of stacking sheets of the sheet sorter 103, a job start signal of the sheet sorter 103, an initialization start signal, a staple start signal, a reversed signal of bin shift direction, a sheet ejection signal, a final sheet ejection signal, etc., of the sheet sorter 103.

In addition, the communication controller 205 transmits data such as the number of bins to be used, a sheet arrival signal for indicating an arrival of a sheet from the image formation apparatus 102, a standby signal for indicating a standby state of the sheet sorter 103, a busy signal for indicating a working state of the sheet sorter 103, a staple-ON signal for indicating a stapling state of the sheet sorter 103, and different kinds of alarm signals for indicating malfunctions, etc. The communication controller 205 performs transmission and reception of such controlling data mainly by a communication control IC (not shown).

The sheet ejected from the image formation apparatus 102 is moved to the sheet carrying unit 2. The controller circuit unit 200 allows the sheet carrying unit controller 203 to operate according to the sheet stacking action designating data which is input by the communication controller 205 to activate a carrying flapper 11 for changing the sheet carrying course. When the sheet is stacked in a stacking tray 30 in a bin unit, it is ejected into the stacking tray 30 of the bin unit 5 through stacking tray ejection rollers 12. Meanwhile, when the sheet is stacked in a stack bin 31 as a stacking means in the bin unit 5, it is carried to the punching unit 4 through a carrying roller 13.

When an entry sensor 16 (a sheet detecting means) detects a top edge of the sheet being carried within the sheet carrying unit 2, the operation unit 7 prohibits acceptance of input for setting a punch action by an operation of a punch setting button 71 (a selection switch).

When a punch action is selected by the operation unit 7, the controller 200 as a controlling means allows the punching unit controller 204 to operate, and allows a punch 28 (a punching means) to operate corresponding to the timing in which a sheet detecting sensor 26 detects the sheet so as to punch holes in the sheet. The punching unit controller 204 detects a punch sensor 27 to stop the punch 28. Then, residue cut out by punching, which is a waste punched-out disk, falls and is contained in a punch-residue container 24, which is a box for containing the residue produced by punching. The punch-residue container 24 has a punch-residue sensor which detects that the punch-residue container 24 is filled with punch-residue. The punched sheet is ejected from stack bin ejection rollers 15 through a carrying roller 14 to a stack bin 31, which is a stacking means.

After all the sheets for the job are stacked, when a staple start signal which is input from the operation unit 7 or the communication controller 205 permits selection of a staple action, the controller 200 allows the staple unit controller 206 and the bin unit controller 202 to operate respectively so as to allow the staple unit 6 to sequentially staple piles of the sheets stacked in the stack bins 31.

Figure 8:
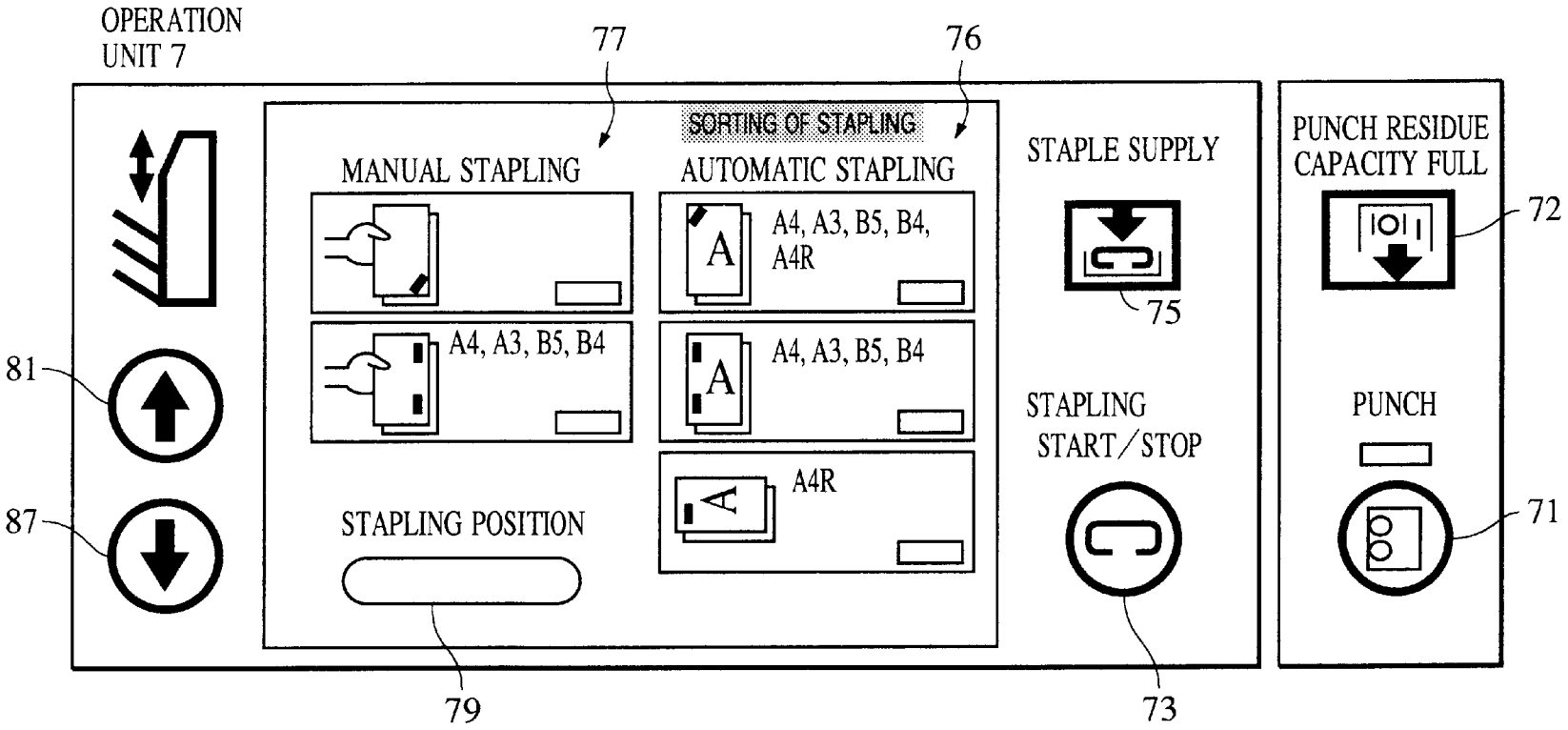
FIG. 8 is a front view of an operation unit of the sheet processor of the present invention.

In the operation unit 7 shown in FIG. 8, numeral 71 denotes a punch setting button, which is a selection signal input means for inputting a selection signal to select a mode either for operating or for not operating the punching means 28 as a processing means; numeral 72 denotes a punch-residue full-capacity display; numeral 73 denotes an operation button for starting or stopping stapling the piles of the sheets; numeral 76 denotes a staple sorting display: numeral 77 denotes a display for indicating positions to be stapled for a manual stapling; numeral 79 denotes an operation button for stapling; and numerals 81 and 82 denote the respective buttons for moving the stack bin 31 up and down.

Referring now to the flowcharts shown in FIGS. 3 to 7, a description will be given of the details in the operation of the embodiment above.

The CPU circuit unit 200 starts a program after the power is turned on (S-1); the CPU 2002, in turn, waits for an input of an initialization start signal in the communication controller 205 (S-2); then, when the start signal for initialization is input, the CPU 2002 performs initialization by controlling the communication controller 205, the bin unit controller 202, the sheet carrying unit controller 203, the punching unit controller 204, the staple unit controller 206, and the operation unit controller 201, respectively.

After initialization, the CPU 2002 sets a punch-input permission flag for giving permission to input a punch action in the operation unit 7 (S-31); then, the CPU 2002 allows the operation unit controller 201 to operate to accept input of a bin action and staple action (S-32), and allows the bin unit controller 202 and the staple unit controller 206 to operate to perform an input action which is designated by a user through the operation unit 7 (S-33); when the job start signal is input in the communication controller 205, the CPU 2002 performs a processing of job starting procedure S-11 (S-34); and when the job start signal is not input in step S-34, the CPU 2002 repeats the processing of step S-32.

In step S-20, the CPU 2002 allows the operation unit controller 201 to operate to accept an input of a punch action selection, when it determines whether the punch action flag for permitting an input of the punch action in the operation unit 7 is set; in step S-21, when the punch action is selected by the operation unit 7, the CPU 2002 sets the punch action flag to perform the procedure of step S-20 (S-22), so that the sheets are punched in the job processing step S-12. In contrast, in step S-21, when the punch action is not selected by the operation unit 7, the CPU 2002 clears the punch action flag to perform the procedure of step S-20 (S-23), so that the sheets are not allowed to be punched in the Job processing step S-12. The CPU 2002 constantly performs the procedure of step S-20.

When the Job start signal is input by the communication controller 205, the CPU 2002 controls the bin unit controller 202, the sheet carrying unit controller 203, the punching unit controller 204, and the staple unit controller 206 to perform a job start processing action for preparing for the job processing (S-11). When a sheet ejection signal is input by the communication controller 205, the CPU 2002 controls the bin unit controller 202 and the sheet carrying unit controller 203 so as to perform a job processing action based on stacking designation data, a bin-shift-direction reverse signal, size data of the sheets to be ejected, and processing speed data of the image formation apparatus, which are input by the communication controller 205.

Figure 7:
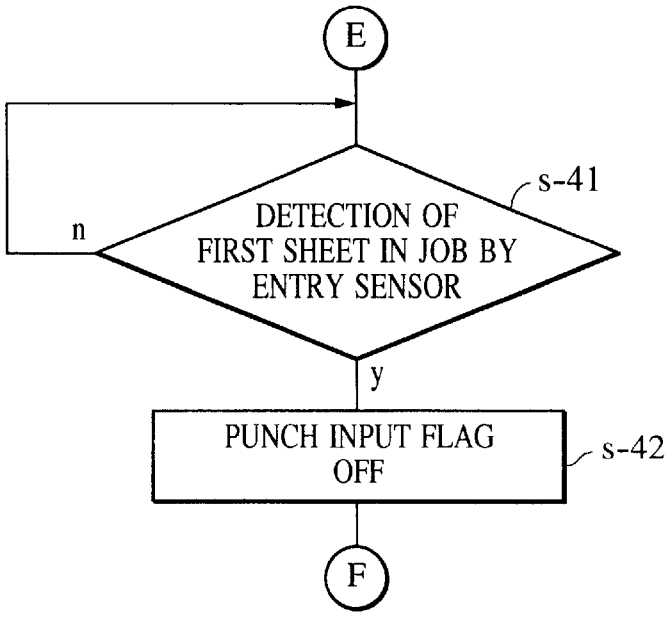

In FIG. 7, the CPU 2002 clears the punch input permission flag to cancel an input of a punch action selection from the operation unit 7 (S-42) when it determines whether the top edge of the sheet is detected by the entry sensor 16 (S-41); and the CPU 2002 controls the punch unit controller 204 to punch holes in the sheet which is being carried (S-12) when it determines whether the punch action flag is set.

In other words, when the top edge of the sheet being carried within the sheet carrying unit is detected by the entry sensor 16 which is a sheet detecting means, the operation unit 7 prohibits the acceptance of an input for setting a punch action made by operating the punch setting button 71. Regarding the punch setting button 71, an action setting of the button 71 which is a punch action selection means is permitted during a specified period of time taken after the start key 211 of the operation unit (not shown) in the image formation apparatus 102 shown in FIG. 1 is operated and the job start signal is input from the main section of the image formation apparatus 102 by the communication controller 205.

The specified period of time mentioned above is the time between an input for starting of an image forming action by the start key 211 and an arrival of the first sheet in the job, which is an image formation on a pile of the sheets, at the entry sensor 16.

This arrangement permits the punching of holes in the sheets carried to the sheet sorter 103, as long as the punch setting button 71 is operated within a specified period of time, even after image formation is started by operating the start key 211; thus, even if the setting of punching is forgotten, both image formation and sheet processing can be continued without putting the apparatus on hold, so that the use environment of the apparatus can be enhanced.

The CPU 2002 controls the bin unit controller 202, the sheet carrying unit controller 203, and the punch unit controller 204 so as to perform a job processing ending action (S-13), when the final sheet ejection signal, etc., is input by the communication controller 205 to eject all the sheets. Furthermore, the CPU 2002 controls the staple unit controller 206 and the bin unit controller 202 so as to perform a stapling procedure on the stacked sheets (S-13), when a staple start signal is input by the communication controller 205, or when a staple action is input for setting by the operation unit 7.

The CPU 2002 performs step S-23 when it determines whether the sheets to be sorted and stacked are removed through a sheet detecting sensor 32 disposed in the stack bins 31. In step S-14, when the CPU 2002 determines whether the sheets to be sorted and stacked are left in the bins 31, it performs step S-15; and then it performs step S-11 for a series of actions when another job start signal for the next job is input by the communication controller 205. The CPU 2002 repeats steps S-13, S-14, and S-15 until a signal for starting the next job is received or the sheets are removed from the stack bin 31.

In the embodiment described above, the start switch disposed in the image formation apparatus is a start signal input means, while the selection switch disposed in the processor is a selection signal input means. However, when a printer connected to a personal computer is used as an image formation apparatus, the computer may be employed as a start signal input means or a selection signal input means.

In addition, the processing means described in the embodiment may be a folding means for folding sheets, or a stamping means for stamping sheets, as an alternative to the punching means.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image formation apparatus having a main section and a sheet processor section, comprising:

image forming means for forming an image on a sheet;

ejecting means for ejecting the sheet on which the image is formed by the image forming means, wherein said image forming means and said ejecting means are contained in the main section of the image formation apparatus;

punching means for punching at least one hole in the sheet ejected from the main section of the image formation apparatus, said punching means disposed in the sheet processor section; and punch action selecting means for selecting punch action; and controlling means for controlling the punch action selecting means, permitting the selection of punch action during a period after a start of image forming signal is input and before the sheet arrives at a predetermined position upstream side of said punching means.

2. An image formation apparatus according to claim 1, further comprising:

sheet detecting means for detecting an arrival of a sheet at the sheet processor section;

wherein the specified interval is the time between an input of a start of image formation signal and the time at which a first sheet upon which an image has been formed arrives at the sheet detecting means from the main section of the image formation apparatus.

3. An image formation apparatus according to claim 2, wherein the sheet detecting means is an entry sensor disposed upstream of the punching means.

4. An image formation apparatus comprising:

image forming means for forming an image on a sheet;

a carrying path for guiding the sheet on which the image is formed by the image forming means;

ejecting means for ejecting a sheet guided by the carrying path;

stacking means for stacking the sheet ejected by the ejecting means;

processing means disposed in the carrying path for performing processing on the sheet guided by the carrying path;

a selection signal input means for inputting a selection signal to select a mode for operation of or non-operation of the processing means;

start signal input means for inputting a start signal to start image formation; and controlling means for controlling the processing means according to the mode selected by the selection signal input means when the selection signal is input after the start signal is input and before the sheet arrives at a predetermined position upstream of said processing means.

5. An image formation apparatus according to claim 4, wherein the controlling means controls the processing means according to the mode selected by the selection signal input means when the selection signal is input before a first sheet upon which an image has been formed arrives at the processing means after input of the start signal.

6. An image formation apparatus according to claim 4, wherein a detecting means is disposed for detecting the sheet upstream of the processing means on the carrying path; and wherein the controlling means controls the processing means according to the mode selected by the selection signal input means, when the selection signal is input before a first sheet upon which an image has been formed is detected by the detecting means after input of the start signal.

7. An image formation apparatus according to claim 4, wherein the selection signal input means comprises a selection switch.

8. An image formation apparatus according to claim 4, wherein the start signal input means comprises a start switch.

9. An image formation apparatus according to claim 4, wherein the processing means comprises a punching means for punching at least one hole in the sheet.

10. An image formation apparatus comprising:

image forming means for forming an image on a sheet;

a carrying path for guiding the sheet on which the image is formed by the image forming means;

ejecting means for ejecting a sheet guided by the carrying path;

stacking means for stacking the sheet ejected by the ejecting means;

processing means disposed in the carrying path for performing processing on the sheet guided by the carrying path;

selection signal input means for inputting a selection signal to select a mode for operation of or non-operation of the processing means;

start signal input means for inputting a start signal to start formation by the image forming means; and controlling means for controlling the processing means according to the mode selected by the selection signal input means, wherein when a first selection signal is input then the start signal is input and then a second selection signal is input before the sheet arrives at a predetermined position upstream of said punching means, the controlling means controls the processing means according to the mode selected by said second selection signal.

11. An image forming apparatus according to claim 10, wherein when a first selection signal is input before the start signal is input and a second selection signal is input after the start signal is input, controlling means controls the processing means according to the mode selected by said second selection signal.

* * * * *

UNITED STATES PATENT AND TRADEMARK OFFICE

CERTIFICATE OF CORRECTION

PATENT NO. : 6,337,970 B1
DATED : January 8, 2002
INVENTOR(S) : Kiyoshi Okamoto et al.

It is certified that error appears in the above-identified patent and that said Letters Patent is hereby corrected as shown below:

Column 1,
Line 61, “includes;” should read -- includes: --.

Column 2,
Line 20, “an” should be deleted.

Column 5,
Line 33, “display:” should read -- display; --.

Column 6,
Lines 7 and 10, “Job” should read -- job --.

Signed and Sealed this

Fourth Day of March, 2003

JAMES E. ROGAN
*Director of the United States Patent and Trademark Office*